US007869734B2

(12) United States Patent
Ukai

(10) Patent No.: US 7,869,734 B2
(45) Date of Patent: Jan. 11, 2011

(54) IMAGE FORMING APPARATUS INCLUDING A HOLDING PORTION HAVING AN AIR VENT

(75) Inventor: Masamitsu Ukai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 780 days.

(21) Appl. No.: 11/777,596

(22) Filed: Jul. 13, 2007

(65) Prior Publication Data

US 2008/0014007 A1 Jan. 17, 2008

(30) Foreign Application Priority Data

Jul. 14, 2006 (JP) ..... 2006-194167

(51) Int. Cl.
*G03G 21/20* (2006.01)

(52) U.S. Cl. ..... 399/92; 399/93

(58) Field of Classification Search ..... 399/92–94, 399/393

See application file for complete search history.

(56) References Cited

U.S. PATENT DOCUMENTS 5,335,049 A 8/1994 Kanai et al.
2004/0096229 A1* 5/2004 Yoshihara et al. ..... 399/33
2005/0051942 A1* 3/2005 Kubo et al. ..... 271/9.09

FOREIGN PATENT DOCUMENTS

| | | |
|---|---|---|
| JP | 5011554 | 1/1993 |
| JP | 7168511 | 7/1995 |
| JP | 10312146 | 11/1998 |
| JP | 2001310529 | 11/2001 |
| JP | 2003202765 | 7/2003 |
| JP | 2004279747 | 10/2004 |
| JP | 2005084155 | 3/2005 |
| JP | 2005091674 | 4/2005 |

OTHER PUBLICATIONS

Machine translation of Tajima et al. (JP 10-312,146, Listed in IDS).*
Machine translation of Miyagawa (JP 2004-279,747, Listed in IDS).*

* cited by examiner

*Primary Examiner*—David M Gray
*Assistant Examiner*—Rodney Bonnette
(74) *Attorney, Agent, or Firm*—Banner & Witcoff, Ltd.

(57) ABSTRACT

An image forming apparatus includes a placement tray on which a recording medium is placed and which is attachably and detachably assembled into a housing. The placement tray includes a holding portion having an upwardly concave configuration at one end of the placement tray in an attaching and detaching direction of the placement tray. The holding portion includes at least one air vent for taking air into the housing in a vicinity of at least one of both end portions of the holding portion in a width direction perpendicular to the attaching and detaching direction.

15 Claims, 10 Drawing Sheets

IMAGE FORMING APPARATUS INCLUDING A HOLDING PORTION HAVING AN AIR VENT

CROSS-REFERENCE TO RELATED APPLICATIONS

This application claims the benefit of Japanese Patent Application No. 2006-194167 filed Jul. 14, 2006 in the Japan Patent Office, the disclosure of which is incorporated herein by reference.

BACKGROUND

The present invention relates to an image forming apparatus, and particularly to an image forming apparatus of an electrophotographic type, such as a laser printer, a copying machine or the like.

A housing of a typical image forming apparatus houses heat generating components, such as a power board and an electric motor. In order to maintain such heat generating components at temperatures lower than respective upper temperature limits, an air vent for taking in cooling air is provided in a holding portion of a paper feed tray which is attachably and detachably assembled into the housing (an image forming apparatus main body) according to a known technique.

The holding portion is a handle portion which a user holds when the user manually attaches or detaches the paper feed tray. The holding portion usually includes a hollow portion having a substantially concave cross section.

SUMMARY

A conveying direction of a recording medium passing through an image forming portion and an attaching and detaching direction of the paper feed tray are usually the same as a front and rear direction of the image forming apparatus, and are parallel with each other. In this case, if the paper feed tray and the image forming portion are arranged so as to be simply aligned horizontally, a horizontal dimension of the image forming apparatus will be increased. Accordingly, the paper feed tray is usually disposed under the image forming portion, that is, in a lower portion of the housing, so that the paper feed tray and the image forming portion are arranged in a vertically layered manner.

Heat generating components, such as the power board and the electric motor, are fixed to a pair of frames, which are substantially vertically disposed on both sides of a conveyance path of the recording medium. This serves to suppress an increase in height of the image forming apparatus.

Accordingly, it is important to introduce cooling air into vicinities of ends in a width direction perpendicular to the conveyance path in the housing, that is, the attaching and detaching direction of the paper feed tray, in order to efficiently cool the heat generating components. It is, however, difficult to efficiently cool the heat generating components disposed in width-direction end portions in the housing by simply providing the air vent in the holding portion.

In view of the above, it is desirable to provide an image forming apparatus in which heat generating components disposed in width-direction end portions in a housing may be efficiently cooled.

The image forming apparatus of the present invention may include a placement tray on which a recording medium is placed and which is attachably and detachably assembled into a housing. The placement tray may include a holding portion having an upwardly concave configuration at one end of the placement tray in an attaching and detaching direction of the placement tray. The holding portion may include at least one air vent for taking air into the housing in a vicinity of at least one of both end portions of the holding portion in a width direction perpendicular to the attaching and detaching direction.

According to the image forming apparatus of the present invention, cooling air may be efficiently guided to width-direction end portions in the housing, and thereby heat generating components disposed in the width-direction end portions may be efficiently cooled.

BRIEF DESCRIPTION OF THE DRAWINGS

The invention will now be described below, by way of example, with reference to the accompanying drawings, in which.

DETAILED DESCRIPTION

An image forming apparatus of the present invention is applied to an image forming apparatus of an electrophotographic type, such as a laser printer, in embodiments of the present invention. In FIGS. 1-10, only major components are shown in an emphasized manner so as to facilitate easy understanding of the embodiments. Accordingly, details shown in FIGS. 1-10 are different, to a certain extent, from those of an actual laser printer.

First Embodiment

1. Configuration of Laser Printer

Figure 1:
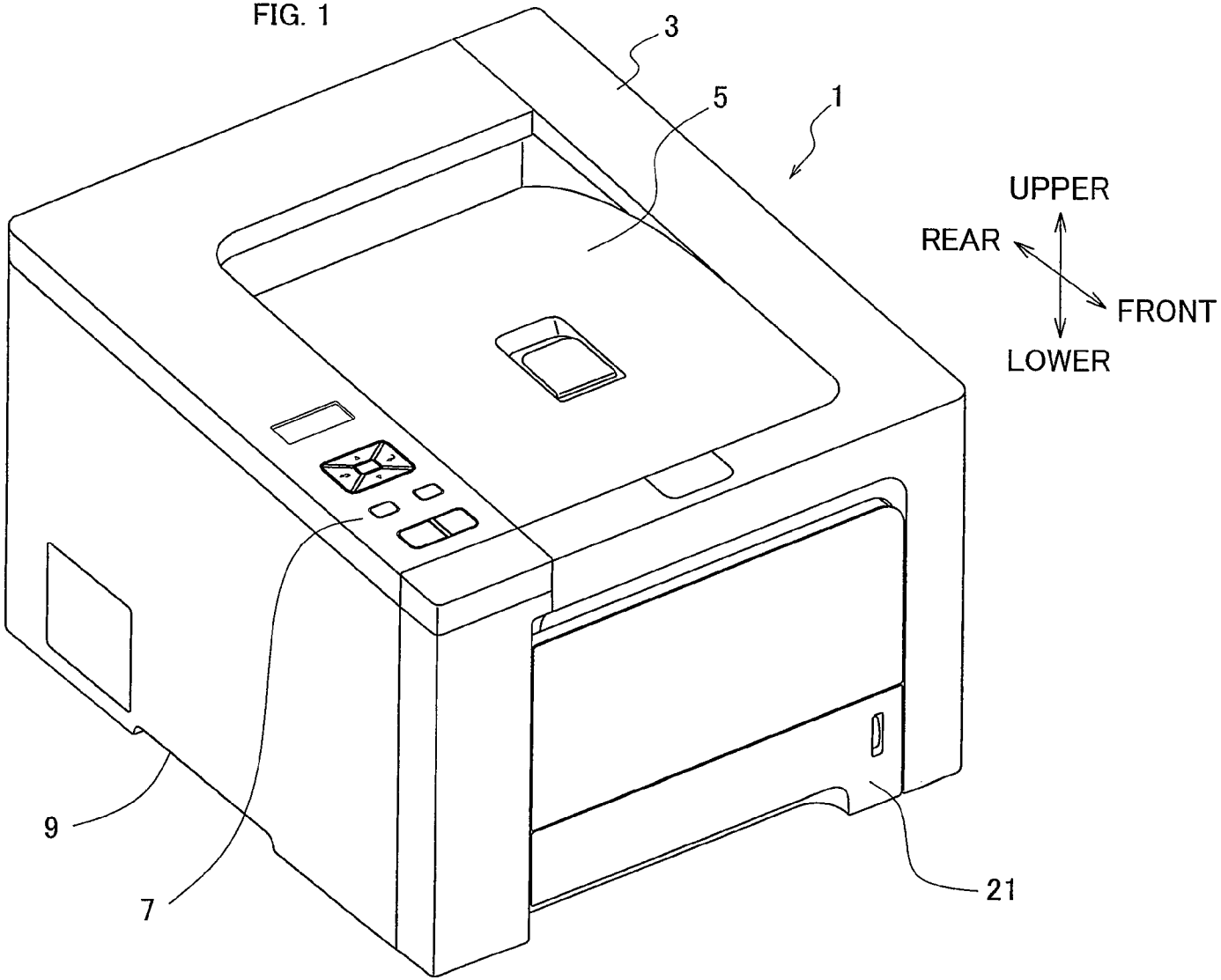
FIG. 1 is a perspective view showing an appearance of a laser printer in a first embodiment of the present invention.

A laser printer 1 of a first embodiment is placed with an upper direction of FIG. 1 as an upper direction of the gravity direction, and usually is used with a right side of FIG. 1 as a front side.

As shown in FIG. 1, a housing 3 of the laser printer 1 having a substantially box-like shape (a cubic shape) covers a frame 100 (see FIG. 5) and constitutes an exterior design.

In an upper side of the housing 3, a paper discharge tray 5, an operation panel 7 and others are provided. A recording medium, such as a sheet of paper or an OHP sheet (hereinafter simply referred to as a "sheet"), discharged from the housing 3 after printing is placed on the paper discharge tray 5. The operation panel 7 is used to perform settings on the laser printer 1. In a lower lateral side of the housing 3, a holding section 9 for lifting the laser printer 1 is provided.

Figure 6:
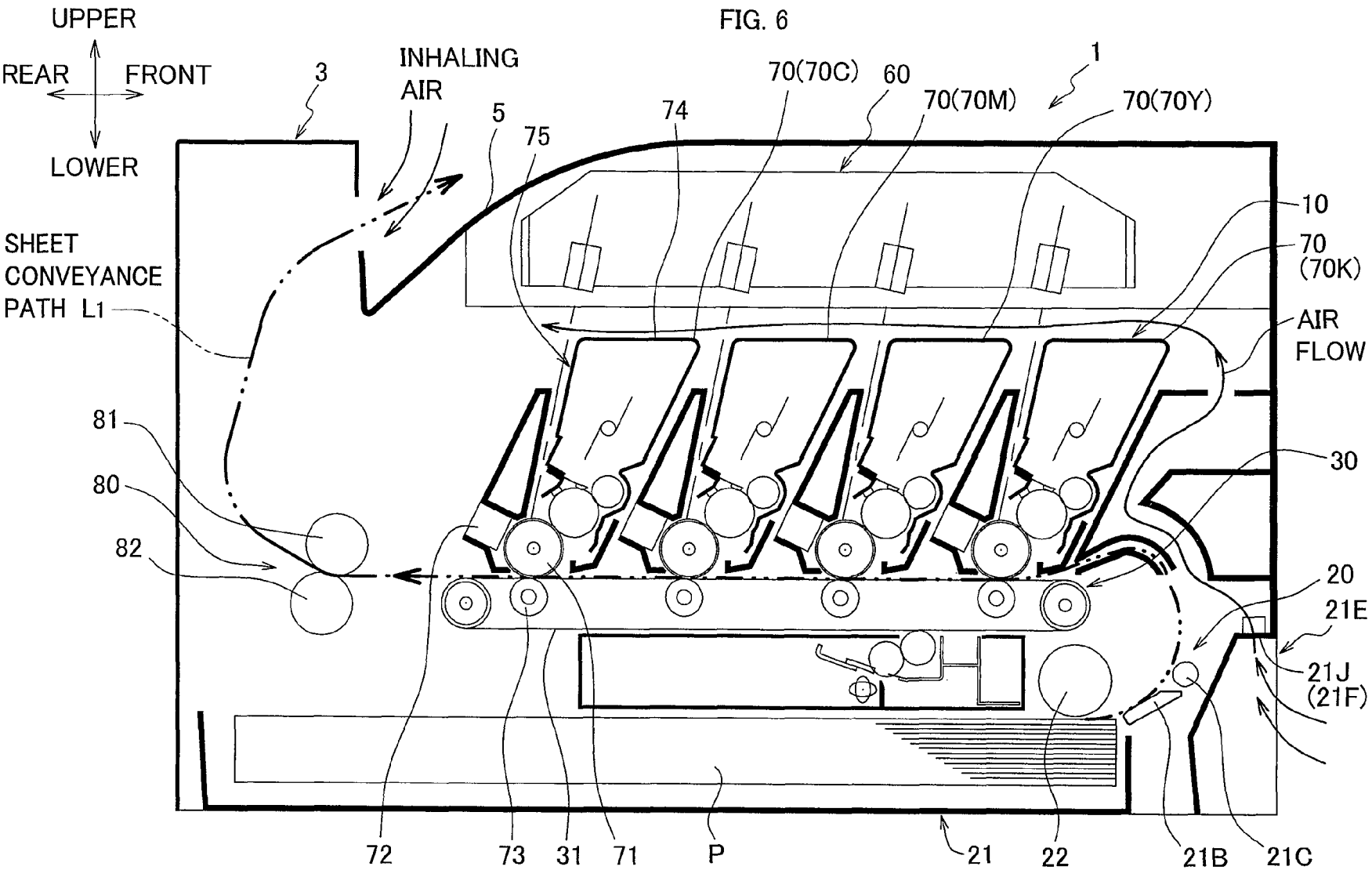
FIG. 6 is a cross-sectional view taken along line VI-VI of FIG. 3.

Also, as shown in FIG. 6, an image forming portion 10, a feeder portion 20, a conveyance mechanism 30, and others are provided inside the housing 3. The image forming portion 10 forms an image on a sheet conveyed through a conveyance path L1 (indicated by a thick two-dotted chain line in FIG. 6)

The feeder portion 20 serves to feed sheets to the image forming portion 10 by pulling out the sheets from a paper feed tray 21 sheet by sheet and feeding the sheets toward the image forming portion 10. The conveyance mechanism 30 conveys the sheets to four developing toner cartridges 70K, 70Y, 70M and 70C which constitute the image forming portion 10.

The feeder portion 20 includes the paper feed tray 21 housed in a bottom section of the housing 3 and a paper feed roller 22 disposed above a front end section of the paper feed tray 21. The paper feed tray 21 is assembled into the housing 3 so as to be attachable and detachable in a direction parallel with a conveying direction of a sheet passing through the image forming portion 10. The paper feed tray 21 will be described further in detail later. The paper feed roller 22 feeds (conveys) a sheet placed on the paper feed tray 21 to the image forming portion 10.

The conveyance mechanism 30 includes a conveyor belt 31 that is rotatingly driven in an interlocking manner with an operation of the image forming portion 10. When the conveyor belt 31 is rotated with a sheet, which is conveyed from the paper feed tray 21 and placed on the conveyor belt 31, the sheet is sequentially conveyed to the four developing toner cartridges 70K, 70Y, 70M, and 70C.

The image forming portion 10 includes a scanner portion 60, a developing toner cartridge 70 and a fixing portion 80. The image forming portion 10 of the present embodiment is of a so-called direct tandem-type which is capable of color printing. In the image forming portion 10, the four developing toner cartridges 70K, 70Y, 70M, and 70C, corresponding respectively to toners (developing agents) of four colors of black, yellow, magenta and cyan, are tandemly arranged from an upstream side along a sheet conveying direction.

Since the four developing toner cartridges 70K, 70Y, 70M, and 70C are identical except for the colors of the toners contained therein, the four developing toner cartridges 70K, 70Y, 70M, and 70C are collectively referred to as the developing toner cartridge 70.

The scanner portion 60 is provided in an upper section of the housing 3, and irradiates a laser beam on a surface of a photosensitive drum 71 provided to each of the four developing toner cartridges 70K, 70Y, 70M, and 70C, to thereby form an electrostatic latent image on the photosensitive drum 71.

The developing toner cartridge 70 is attachably and detachably disposed under the scanner portion 60 in the housing 3. The developing toner cartridge 70 includes the photosensitive drum 71, a charger 72, and a casing 75 for housing a toner container 74 and others. A transfer roller 73 is rotatably held by a later-described frame 100 so as to face the photosensitive drum 71 with the conveyor belt 31 located therebetween.

The fixing portion 80 heats and dissolves the toner transferred onto the sheet, thereby to fix the toner. The fixing portion 80 includes a heating roller 81 and a pressure roller 82. The heating roller 81 is disposed on a printing surface side of a sheet and applying a conveying force to the sheet while heating the toner on the sheet. The pressure roller 82 is disposed on a reverse side of the sheet so as to press the sheet toward the heating roller 81.

The image forming portion 10, including the scanner portion 60, the developing toner cartridge 70 and the fixing portion 80, is assembled to the frame 100 housed in the housing 3. The frame 100 includes a first side frame 101 and a second side frame 102 having a substantially plate-like configuration and provided on both sides in a direction (hereinafter also referred to as a "width direction") perpendicular to an attaching and detaching direction of the paper feed tray 21 with a conveyance path L1 located between the first side frame 101 and the second side frame 102.

Figure 5:
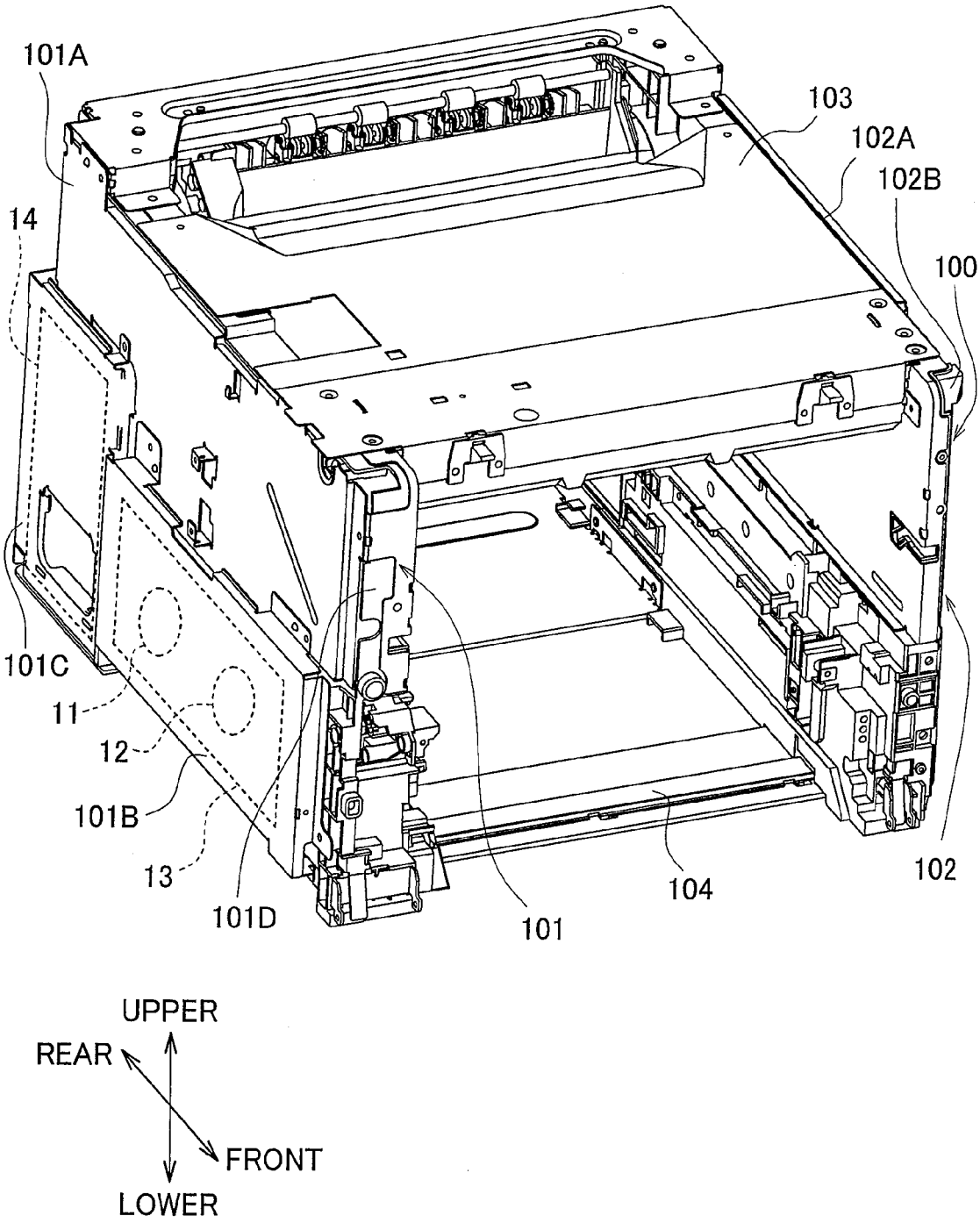
FIG. 5 is a perspective view showing a frame of the laser printer in the first embodiment.

As shown in FIG. 5, an upper end of the first side frame 101 and an upper end of the second side frame 102 are connected by a top panel plate 103, while a lower end of the first side frame 101 and a lower end of the second side frame 102 are connected by a bottom frame 104.

The first side frame 101 includes plates 101A-101C made of metal, such as SPCC (cold rolled carbon steel sheets), and a frame 101D made of resin having a high mechanical strength, such as PC (Polycarbonate) resin, ABS resin or polymer alloy. The metal plates 101A-101C are assembled to the resin frame 101D by a mechanical fastening device, such as a slotted pan head screw.

The second side frame 102 also includes, similar to the first side frame 101, a frame 102B made of resin and a plate 102A made of metal and assembled to the resin frame 102B.

A group of gears (not shown), an engine control board 13 and a main control board 14 are assembled to the frame 101D (the first side frame 101). The group of gears transmit power to the transfer roller 73 and the like. The engine control board 13 controls electric motors 11 and 12 which rotatingly drive the photosensitive drum 71 and the like. The main control board 14 controls the entire laser printer 1.

A high voltage power board 15 (see FIG. 4) and a low voltage power board 16 (see FIG. 4) are assembled to the frame 102B (the second side frame 102). The high voltage power board 15 supplies power of high voltage to devices, such as the charger 72, requiring high voltage, while the low voltage power board 16 supplies power of low voltage compared with the high voltage power board 15.

The plate 101A is for covering the above-mentioned group of gears and the like. The plate 101B is for covering the engine control board 13. The plate 101C is for covering the main control board 14. The plate 102A is for covering the high voltage power board 15 and the low voltage power board 16.

Figure 2:
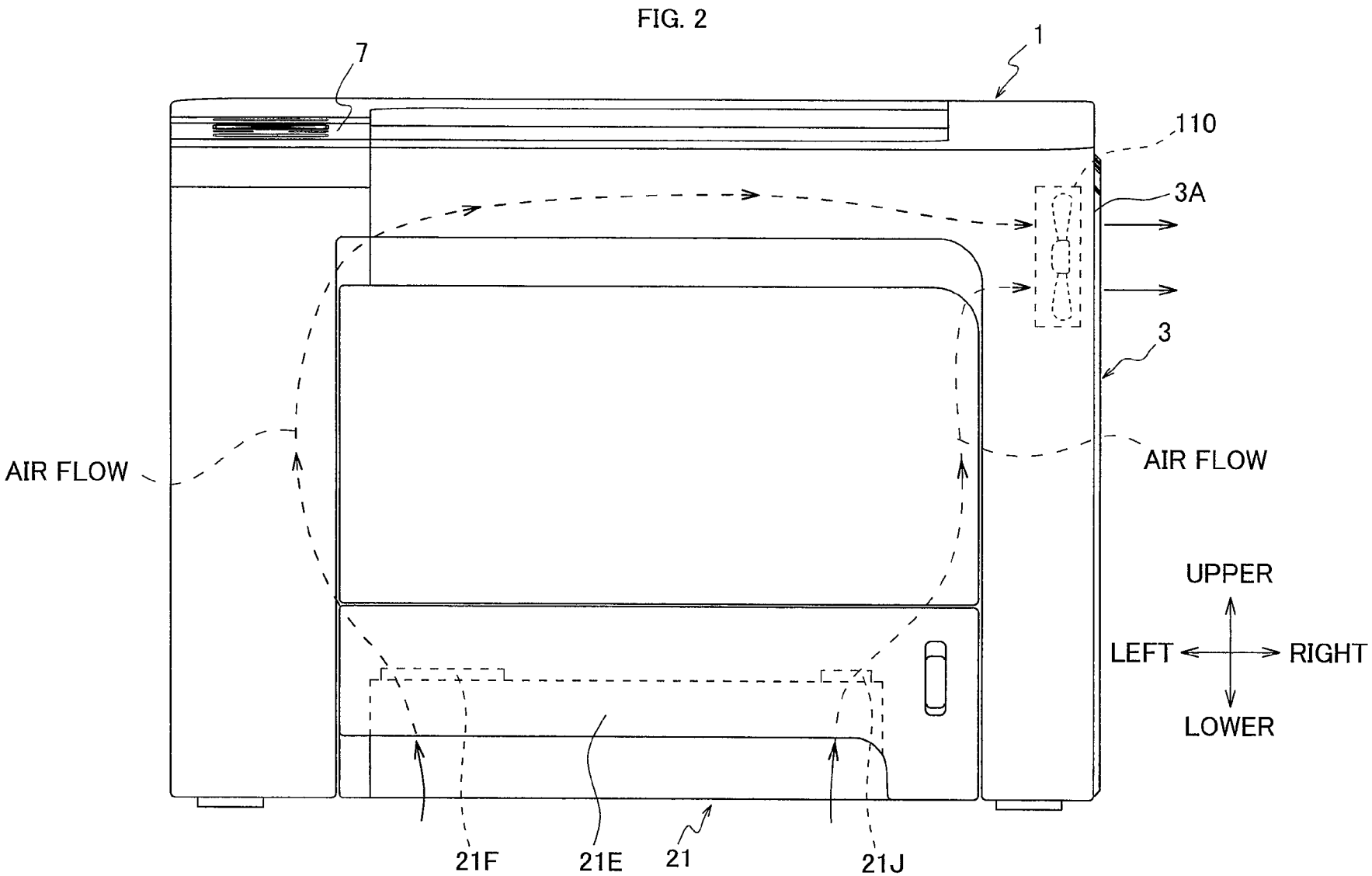
FIG. 2 is a front elevation view showing the laser printer in the first embodiment.
Figure 3:
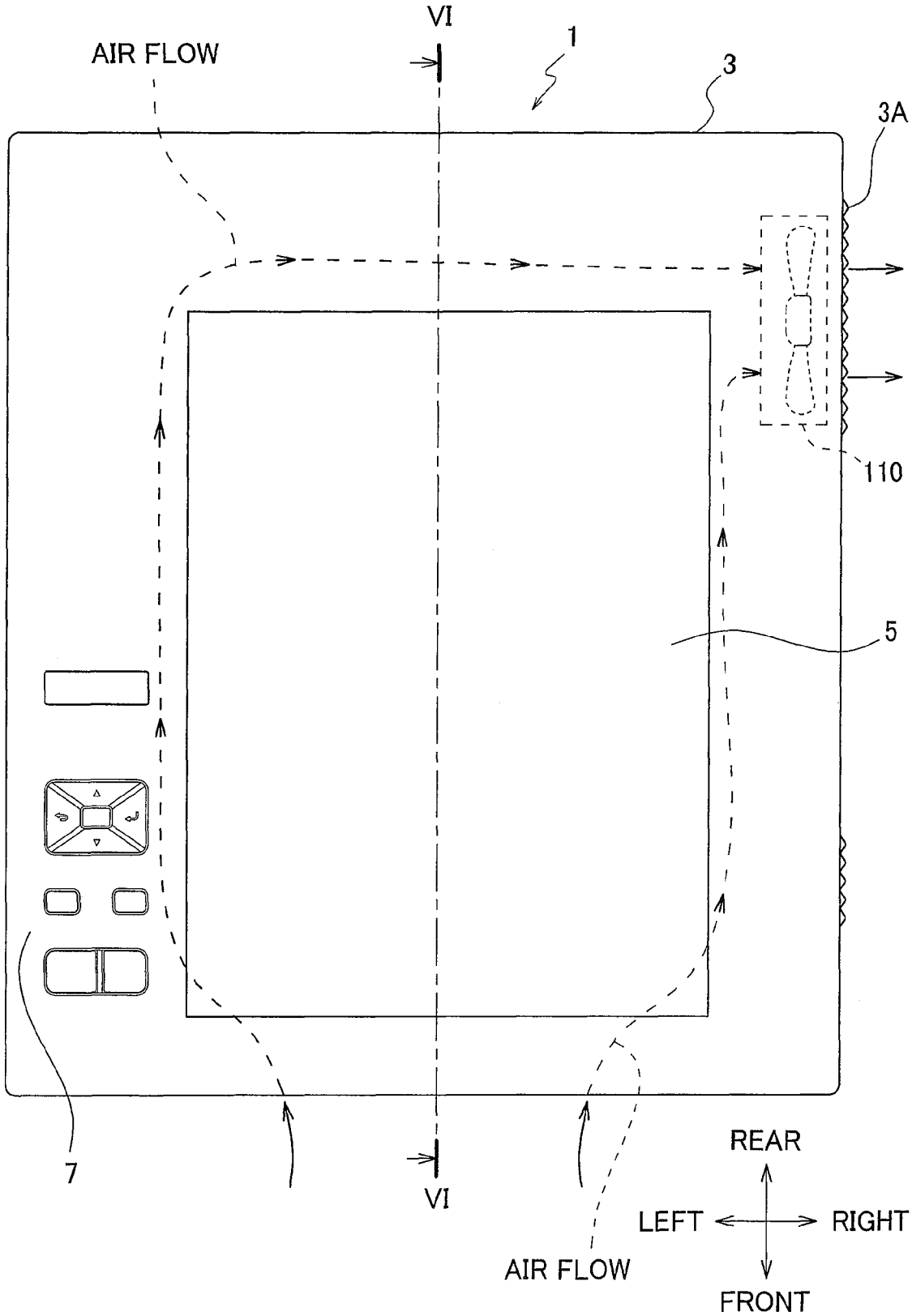
FIG. 3 is a top plan view of the laser printer in FIG. 2.
Figure 4:
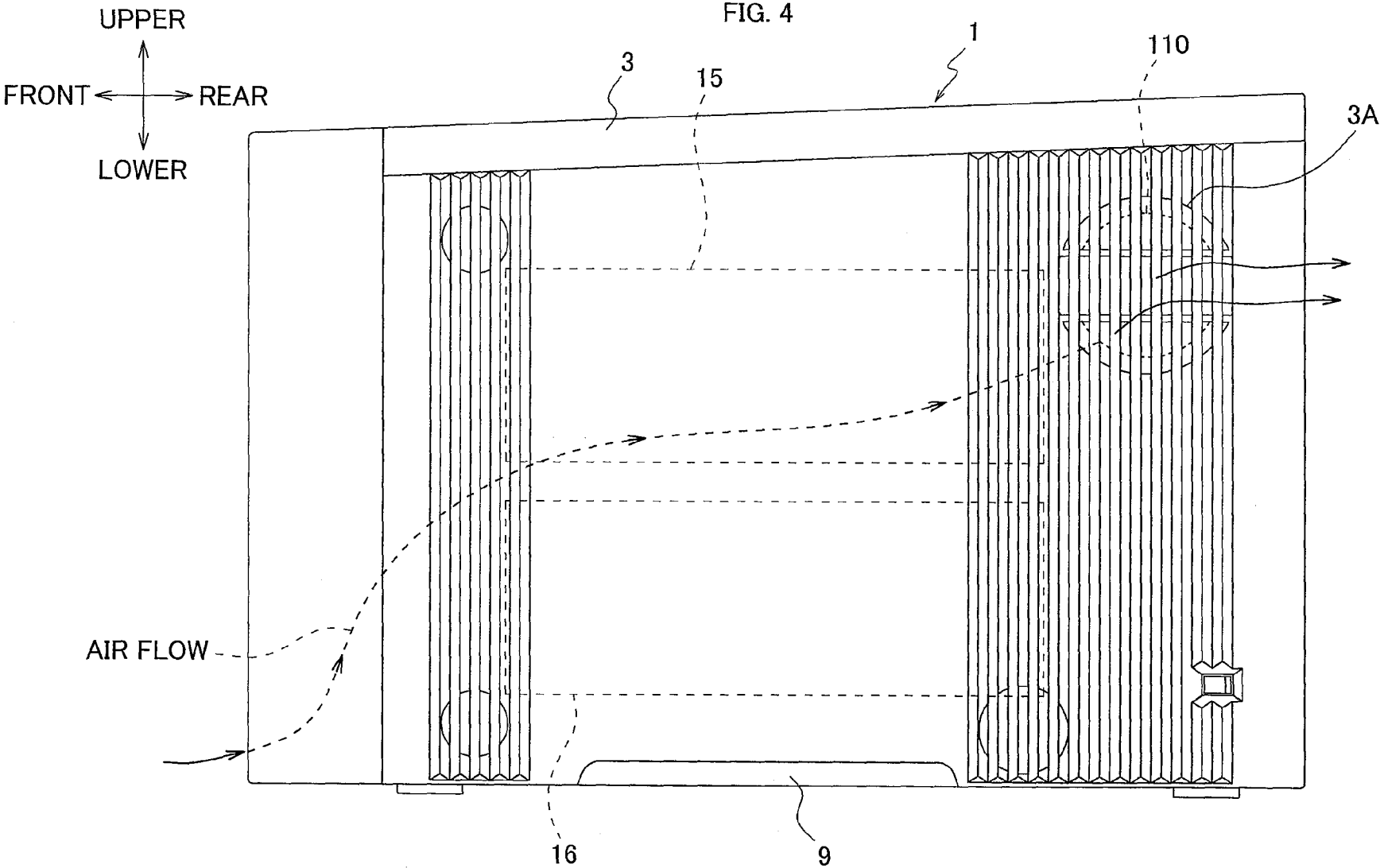
FIG. 4 is a right side elevation view of the laser printer in FIG. 2.

As shown in FIGS. 2-4, a fan 110 for exhausting air in the housing 3 to an outside of the housing 3 is provided in the housing. As shown in FIG. 4, the fan 110 is disposed in a vicinity of the high voltage power board 15 and the low voltage power board 16. An exhaust vent 3A for exhausting air in the housing 3 is provided in a portion of a lateral side of the housing 3 corresponding to the fan 110. The fan 110 in the present embodiment includes an axial flow fan (see JIS B 0132, No. 1012 etc.).

2. Paper Feed Tray

The paper feed tray 21 is a placement tray on which a plurality of sheets P to be conveyed to the image forming portion 10 are placed. As shown in FIG. 6, each sheet P placed on the paper feed tray 21 is fed upwardly from one end portion (on a right side of FIG. 6) of the paper feed tray 21 in the attaching and detaching direction of the paper feed tray 21. Then, a conveying direction of the sheet P is changed toward the other end portion (on a left side of FIG. 6) in the attaching and detaching direction, and the sheet P is conveyed toward the image forming portion 10 (the developing toner cartridge 70) disposed above the paper feed tray 21.

Figure 7:
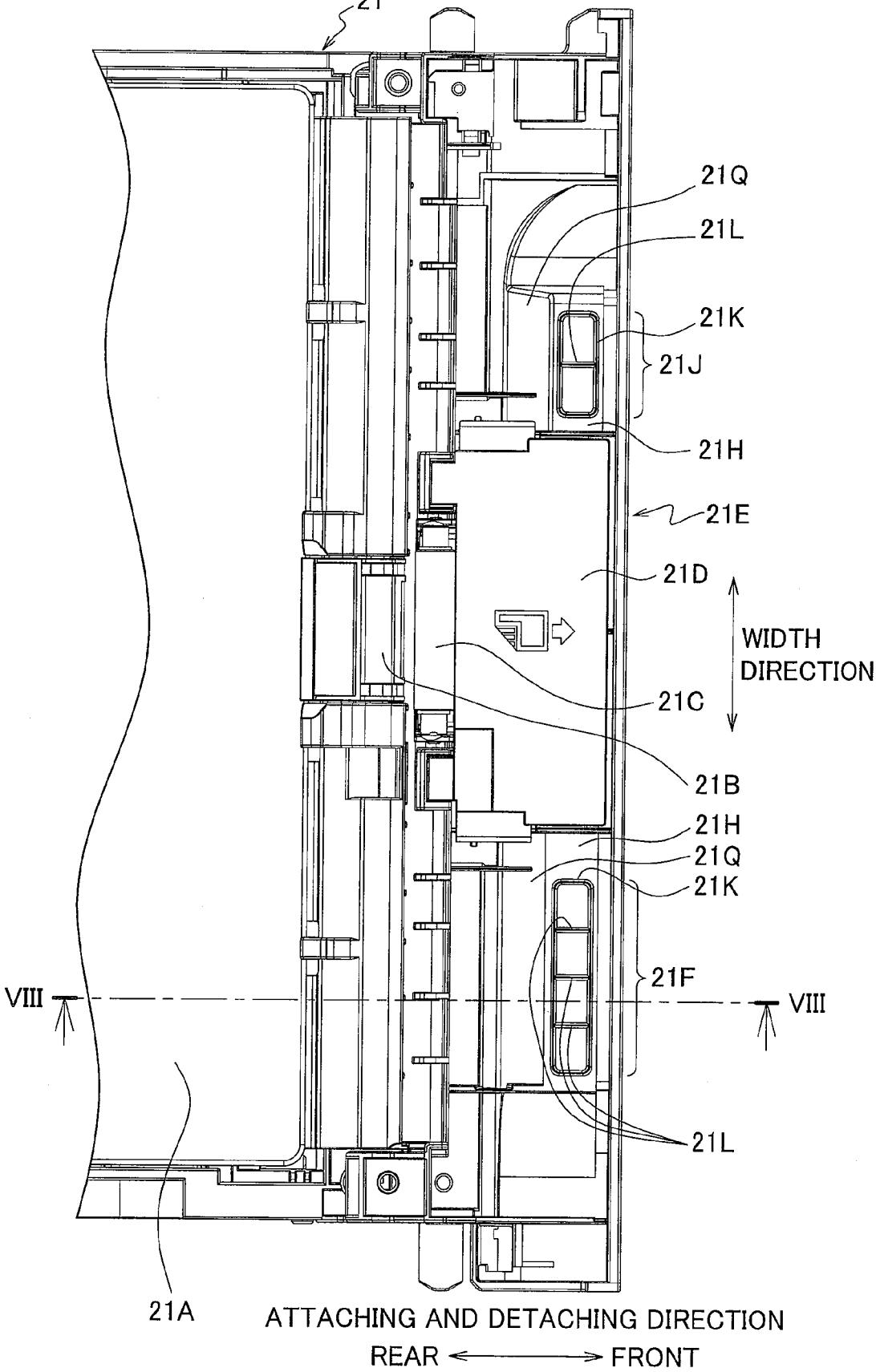
FIG. 7 is a top plan view of a paper feed tray on a side of a holding portion in the first embodiment.

As shown in FIG. 7, the paper feed tray 21 includes a paper placement portion 21A, a separation pad 21B, a paper dust removing roller 21C and a paper dust box 21D. The paper placement portion 21A is a tray-like portion on which the sheets P are placed.

The separation pad 21B is disposed on an opposite side to the paper feed roller 22 with a sheet P to be conveyed located therebetween. The separation pad 21B applies a predetermined conveyance resistance (a friction force) to the sheet P, thereby to separate the sheets P stacked on the paper placement portion 21A sheet by sheet.

The paper dust removing roller 21C is disposed downstream from the separation pad 21B in the conveying direction, and removes paper dust generated due to friction between the separation pad 21B and the sheet P. Paper dust removed by the paper dust removing roller 21C is collected in the paper dust box 21D.

The separation pad 21B, the paper dust removing roller 21C and the paper dust box 21D are disposed substantially in a central portion of the paper feed tray 21 in the width direction and in the one end portion (on a right side of FIG. 7) of the paper feed tray 21 in the attaching and detaching direction. A holding portion 21E is provided in the one end portion so that a user may hold the paper feed tray 21 when manually attaching or detaching the paper feed tray 21.

Figure 8:
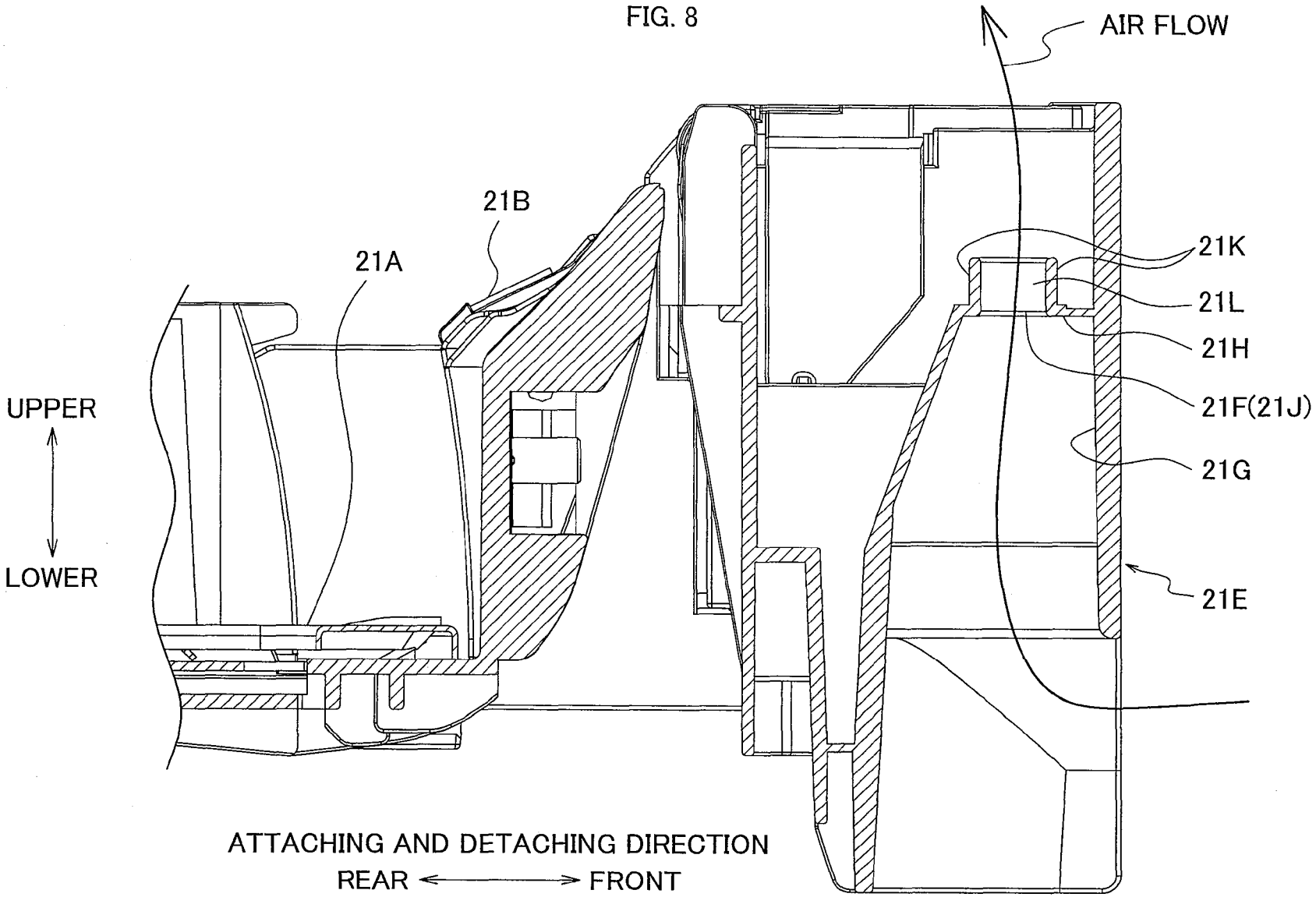
FIG. 8 is a cross-sectional view taken along line VIII-VIII of FIG. 7.

As shown in FIG. 8, the holding portion 21E provided in the one end portion of the paper feed tray 21 has an upwardly concave configuration, that is, a groove configuration which is downwardly open and horizontally extends over substantially an entire length in the width direction of the paper feed tray 21. To detach the paper feed tray 21 from the housing 3, fingers are placed on an inner wall surface 21G, which is located on a detachment side (a right side of FIG. 8) in the attaching and detaching direction, of an inner side wall of the holding portion 21E, and then the paper feed tray 21 is pulled out with the fingers.

As shown in FIG. 7, air vents 21J and 21F for taking air into the housing 3 are provided, in vicinities of both ends of an upper surface portion 21H of the holding portion 21E in the width direction, with the paper dust box 21D located therebetween.

The vicinities of both ends may mean areas which are closer to the both ends than to a center of the holding portion 21E in the width direction. The air vents 21J and 21F, and the paper dust box 21D are disposed so as to be aligned on a substantially straight line in a width direction.

A wall portion 21K protruding toward an inside of the housing 3 is provided along an entire periphery of each of the air vents 21J and 21F. The holding portion 21E and the wall portion 21K are integrally formed with a resin in the present embodiment.

The air vents 21J and 21F are provided at least on a side of the first side frame 101 and a side of the second frame 102 in the holding portion 21E, that is, on both end sides in the width direction of the paper feed tray 21. Bridge portions 21L are provided to the air vents 21J and 21F, respectively, so as to connect respective one sides (on a right side in FIG. 7) of the peripheries to the respective opposing sides (on a left side in FIG. 7) of the peripheries in the attaching and detaching direction.

In the present embodiment, an opening area of the air vent 21J located upper in FIG. 7, is smaller than an opening area of the air vent 21F located lower in FIG. 7. Accordingly, the air vent 21J is divided into two air vent holes by one bridge portion 21L, while the air vent 21F is divided into four air vent holes by three bridge portions 21L. This only results from configurations of vicinities of the air vents 21J and 21F, and the opening area of the air vent 21J and the opening area of the air vent 21F are preferably equal without such a reason.

In the present embodiment, bridge portions 21L having substantially the same height as a height of the wall portion 21K are provided so as to connect respective one sides of the peripheries to the respective opposing sides of the peripheries in the attaching and detaching direction. However, the height of the bridge portions 21L may be smaller than the height of the wall portion 21K.

3. Features of Laser Printer in Present Embodiment

When the fan 110 is operated and the air in the housing 3 is exhausted through the exhaust vent 3A, an air pressure in the housing 3 is decreased, and thereby cooling air is taken in through the air vents 21J and 21F. In the present embodiment, the air vents 21J and 21F for taking in cooling air are provided respectively close to the side frame 101 and the second side frame 102 in the upper surface portion 21H of the holding portion 21E, in other words, respectively close to the electric motor 11, the high voltage power board 15 and the low voltage power board 16. Accordingly, cooling air may be efficiently guided to the heat generating components, such as the electric motor 11. Thus, the electric motor 11, the high voltage power board 15 and the low voltage power board 16 disposed in width-direction end portions in the housing 3 may be efficiently cooled.

A part of air introduced into the housing 3 through the air vents 21J and 21F flows along the developing toner cartridge 70K toward the scanner portion 60, as shown by an arrow indicating air flow in FIG. 6. The part of air cools the scanner portion 60, the developing toner cartridge 70 and others, and is exhausted through the exhaust vent 3A to the outside of the housing 3. The remaining part of the air flows toward the first side frame 101 and the second frame 102, cools the electric motor 11, the high voltage power board 15, the low voltage power board 16, and others, and then is exhausted through the exhaust vent 3A to the outside of the housing 3, as shown by arrows indicating air flows in FIGS. 2-4.

Since the user attaches or detaches the paper feed tray 21 while holding the holding portion 21E, a large force (hereinafter also referred to as a "holding force") is exerted on the holding portion 21E. Accordingly, the holding portion 21E is required to have a mechanical strength sufficient to resist the holding force. Air vents provided in the holding portion 21E are likely to excessively decrease the mechanical strength of the holding portion 21E.

In the present embodiment, however, the wall portion 21K protruding toward the inside of the housing 3 along the periphery of each of the air vents 21J and 21F functions as a reinforcing member thereby to prevent an excessive decrease in the mechanical strength of the holding portion 21E.

In the present embodiment, the air vents 21J and 21F, which are provided on the both sides in the width direction with the paper dust box 21D located therebetween, and the paper dust box 21D are disposed so as to be aligned on a substantially straight line. Accordingly, the air vents 21J and 21F overlap the paper dust box 21D when seen from the width direction of the paper feed tray 21. This may suppress an increase in an outer dimension of the paper feed tray 21 in the attaching and detaching direction.

In the present embodiment, the bridge portions 21L provided to the air vents 21J and 21F function as reinforcing members for the holding portion 21E. Accordingly, a decrease in the mechanical strength of the holding portion 21E by providing the air vents 21J and 21F may be compensated by the bridge portions 21L.

The present invention is especially effective when applied to a color laser printer, in which a heat generation amount in the housing 3 is larger than that in a black and white laser printer.

Second Embodiment

Since a laser printer in a second embodiment is configured substantially the same as the image forming apparatus in the first embodiment shown in FIGS. 1-8, only differences from the first embodiment will be described below.

In the first embodiment, the decrease in the mechanical strength of the holding portion 21E is suppressed by providing the bridge portions 21L to the air vents 21J and 21F.

Figure 9:
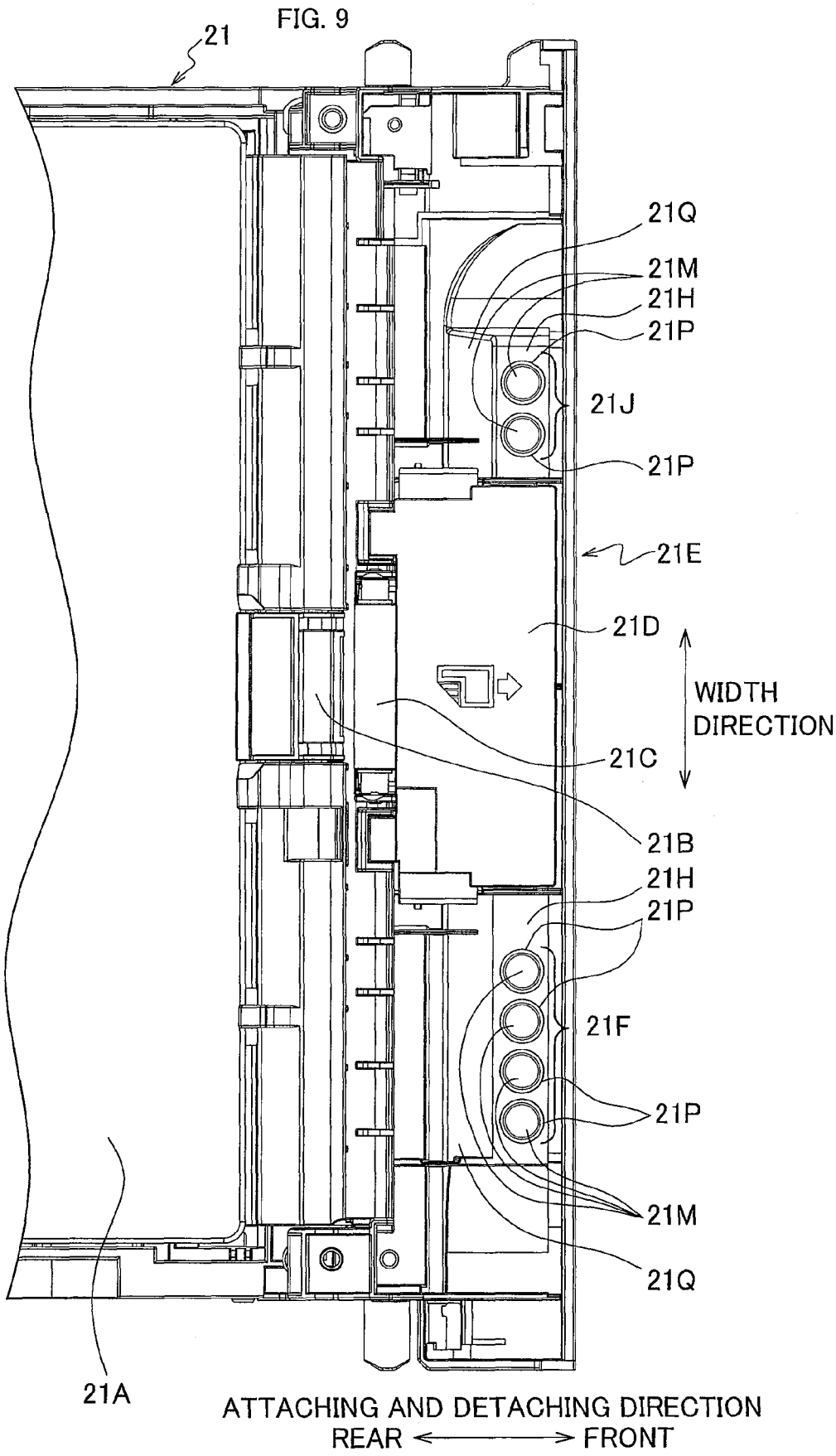
FIG. 9 is a top plan view of a paper feed tray on a side of a holding portion in a second embodiment of the present invention.

In the second embodiment, as shown in FIG. 9, each of the air vents 21J and 21F is constituted by a plurality of air vent holes 21M aligned in a horizontal direction perpendicular to the attaching and detaching direction (i.e., in the width direction of the paper feed tray 21). Accordingly, portions between respective neighboring air vent holes 21M function as reinforcing members for the holding portion 21E in the present embodiment. Thus, a decrease in the mechanical strength of the holding portion 21E by providing the air vents 21J and 21F may be reduced. Also, a wall portion 21P, which is provided along a periphery of each of the air vent holes 21M so as to protrude toward the inside of the housing 3, functions as a reinforcing member thereby to suppress a decrease in the mechanical strength of the holding portion 21E.

Other Embodiments

In the first embodiment, the wall portion 21K is provided along an entire periphery of each of the air vents 21J and 21F. However, the present invention is not limited to such a configuration, and a necessary and sufficient mechanical strength may be obtained by the wall portion 21K provided at least in a direction in parallel with the attaching and detaching direction of the paper feed tray 21.

In the first embodiment, the wall portion 21K is provided to the periphery of each of the air vents 21J and 21F. However, the present invention is not limited to such a configuration, and the wall portion 21K may be omitted. In this case, the mechanical strength should be secured by, for example, increasing a thickness of the bridge portions 21L or the holding portion 21E.

Although the bridge 21L is provided in the first embodiment, the present invention is not limited to such a configuration, and the bridge portion 21L, for example, may be omitted.

The paper dust box 21D and the air vents 21J and 21F are disposed so as to be aligned on a straight line in the width direction in the above described embodiments. However, the present invention is not limited to such a configuration.

Figure 10:
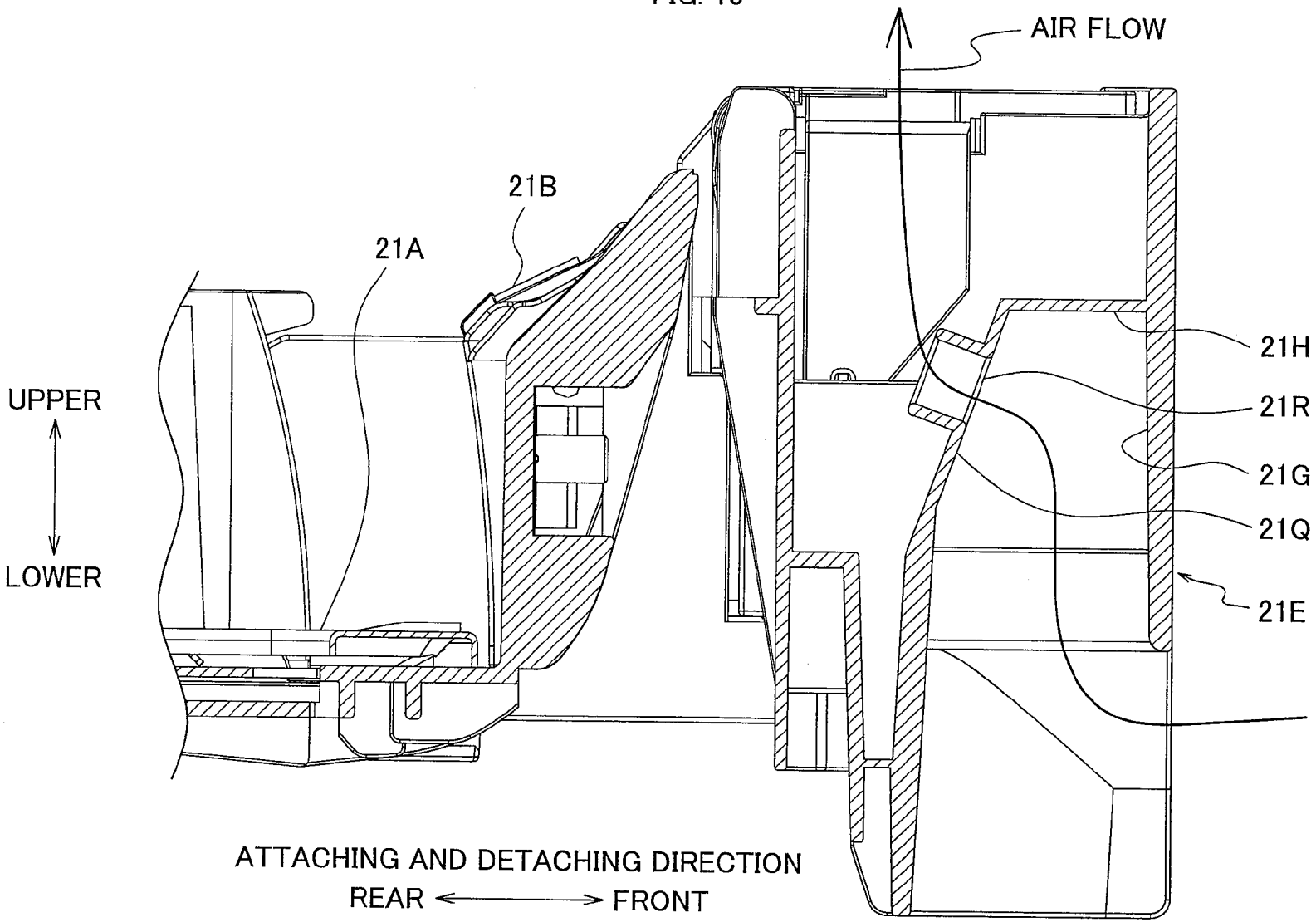
FIG. 10 is a cross-sectional view corresponding to FIG. 8 and showing an example of a holding portion with an air vent located at a position different from a position in the first embodiment.

In the above described embodiments, the air vents 21J and 21F are provided in the upper surface portion 21H of the holding portion 21E. However, the air vents 21J and 21F may be provided in any end portions of the holding portion 21E in the width direction as long as the air vents 21J and 21F do not obstruct the drawing of the paper feed tray 21 and allow air flow inside the housing 3. For example, it may be possible to provide an air vent 21R in an oblique portion 21Q, as shown in FIG. 10. It may also be possible to provide air vents in a plurality of walls, such as in the upper surface portion 21H and the oblique portion 21Q.

In the above described embodiments, the wall portion 21K is provided, in an upward direction, substantially perpendicularly to the upper surface portion 21H. However, the wall portion 21K may be provided, for example, in a downward direction. Also, the wall portion 21K need not necessarily be provided substantially perpendicularly to the upper surface portion 21H.

In the above described embodiments, the exhaust vent 3A is provided in the lateral side of the housing 3. It may be possible, however, to provide an exhaust vent in a rear side or an upper side of the housing.

The paper feed tray 21 is provided in the bottom section of the housing in an attachable and detachable manner in the above described embodiments. The paper feed tray 21, however, need not necessarily be provided in the bottom section.

In the above described embodiments, the paper dust removing roller 21C and the paper dust box 21D are provided. However, the present invention is not limited to such a configuration, and the paper dust removing roller 21C and the paper dust box 21D may be omitted.

The fan 110 is constituted by an axial flow fan in the above described embodiments. However, the present invention is not limited to such a configuration, and the fan 110 may be constituted by another fan, such as a centrifugal fan (see JIS B 0132, No. 1004 etc.) or a cross flow fan (see JIS B 0132, No. 1017 etc.).

The present invention is applied to a direct tandem-type color printer in the above described embodiments. However, the present invention is not limited to such a configuration, but may also be applied to a black and white printer, a four-cycle color printer, or the like.

It will be understood that the present invention should not be limited to the above described embodiments, but may be embodied in various forms within the scope of matters described in the claims.

What is claimed is:

1. An image forming apparatus, comprising:

a housing;

a placement tray on which a recording medium is placed and which is attachably and detachably assembled into the housing, wherein the placement tray includes a holding portion having an upwardly concave configuration at one end of the placement tray in an attaching and detaching direction of the placement tray, wherein the holding portion includes at least one air vent for taking air into the housing in a vicinity of at least one of both end portions of the holding portion in a width direction perpendicular to the attaching and detaching direction, and wherein the at least one air vent includes a wall portion protruding from at least a part of a periphery of the at least one air vent.

2. The image forming apparatus according to claim 1, wherein the wall portion protrudes toward an inside of the housing.

3. The image forming apparatus according to claim 1, wherein the placement tray includes a collecting portion that collects paper dust, and wherein the at least one air vent is aligned on a substantially straight line with the collecting portion in the width direction.

4. The image forming apparatus according to claim 1, wherein the at least one air vent includes two air vents provided in vicinities of the both end portions of the holding portion in the width direction.

5. The image forming apparatus according to claim 4, wherein the placement tray includes a collecting portion that collects paper dust, wherein the collecting portion is provided between the two air vents, and wherein the two air vents and the collecting portion are aligned on a substantially straight line in the width direction.

6. The image forming apparatus according to claim 1, wherein a bridge portion is provided to the at least one air vent so as to connect two regions of a periphery of the at least one air vent.

7. The image forming apparatus according to claim 6, wherein the bridge portion is provided substantially in parallel with the attaching and detaching direction.

8. The image forming apparatus according to claim 1, wherein the at least one air vent includes a plurality of air vent holes aligned in the width direction.

9. The image forming apparatus according to claim 1, further comprising:

an image forming portion that forms an image on the recording medium conveyed along a conveyance path;

a pair of frames substantially vertically disposed on both sides of the conveyance path located therebetween, wherein the housing houses at least a part of the image forming portion and at least a part of the pair of frames; and at least one heat generating component that is disposed in the housing and is fixed to at least one of the pair of frames.

10. The image forming apparatus according to claim 9, wherein at least one of the at least one heat generating component is an electric component, including a power board and an electric motor.

11. The image forming apparatus according to claim 9, wherein the at least one air vent is provided in a vicinity of an end portion of the holding portion on a side of a frame to which the at least one heat generating component is fixed.

12. The image forming apparatus according to claim 1, further comprising:

an exhaust vent provided to the housing; and an exhaust fan that is provided inside the housing and exhausts air through the exhaust vent, thereby to generate an air flow from the at least one air vent to the exhaust vent via a vicinity of the frame to which the at least one heat generating component is fixed.

13. An image forming apparatus, comprising: a housing; an image forming portion disposed in the housing to form an image on a sheet; and a placement tray on which the sheet is placed and which is detachably installable to the housing, the placement tray including: a sheet accommodating portion that accommodates the sheet; and a holding portion disposed at an end of the sheet accommodating portion, the holding portion having a first wall, a second wall opposing the first wall and a third wall connecting the first wall and the second wall, wherein the holding portion includes at least one air vent that communicates an area inside the housing with an area surrounded by the first wall, the second wall and the third wall, while the placement tray is installed to the housing, and wherein the at least one air vent includes a wall portion protruding from at least a part of a periphery of the at least one air vent.

14. The image forming apparatus according to claim 13, wherein the wall portion protrudes toward an inside of the housing.

15. An image forming apparatus, comprising: a housing; an image forming portion disposed in the housing to form an image on a sheet; and a placement tray on which the sheet is placed and which is detachably installable to the housing, the placement tray including: a sheet accommodating portion that accommodates the sheet; and a holding portion disposed at an end of the sheet accommodating portion, the holding portion having a first wall, a second wall opposing the first wall and a third wall connecting the first wall and the second wall, wherein the holding portion includes at least one air vent that communicates an area inside the housing with an area surrounded by the first wall, the second wall and the third wall, while the placement tray is installed to the housing, wherein the placement tray includes a collecting portion that collects paper dust, and wherein the at least one air vent is aligned on a substantially straight line with the collecting portion in the width direction.

* * * * *